United States Patent [19]

Balzer et al.

[11] 4,430,833

[45] Feb. 14, 1984

[54] WALL PROTECTION ASSEMBLY

[75] Inventors: Claude P. Balzer; Edward M. Corman, both of Wichita, Kans.

[73] Assignee: Balco, Inc., Wichita, Kans.

[21] Appl. No.: 253,867

[22] Filed: Apr. 13, 1981

[51] Int. Cl.[3] ..... E04F 13/06; E04F 19/02

[52] U.S. Cl. ..... 52/255; 52/287; 52/288

[58] Field of Search ..... 52/254–256, 52/287, 288, 716, 718, 461

[56] References Cited

U.S. PATENT DOCUMENTS

| | | | |
|---|---|---|---|
| 3,001,330 | 9/1961 | Czaplicke | 52/254 |
| 3,559,356 | 2/1971 | Koral | 52/254 |
| 3,712,003 | 1/1973 | Hallock et al. | 52/288 |
| 3,717,968 | 2/1973 | Olsen et al. | 52/288 |
| 3,825,229 | 11/1974 | Bartlett et al. | 52/716 |
| 4,104,839 | 8/1978 | Balzer et al. | 52/288 |
| 4,126,978 | 11/1978 | Heller | 52/461 |
| 4,161,853 | 7/1979 | Weiss et al. | 52/254 |
| 4,200,261 | 4/1980 | Bartlett | 52/718 |

*Primary Examiner*—James L. Ridgill, Jr.

*Attorney, Agent, or Firm*—Schmidt, Johnson, Hovey & Williams

[57] ABSTRACT

A wall protecting assembly is provided for protecting outwardly exposed intersecting wall surfaces adjacent the intersection thereof comprising a rigid base plate securely attached to the wall surfaces and overlying an associated corner and a semi-resilient cover member mounted in spaced relation to the base plate. A cushion member projects outwardly from the base plate adjacent the corner so as to cushion impacts administered to the cover member and retains the cover member in spaced apart relationship relative to the base plate. Stop members are utilized to maintain spacing between the base plate and the cover member at locations spaced from the intersection.

7 Claims, 13 Drawing Figures

WALL PROTECTION ASSEMBLY

BACKGROUND OF THE INVENTION

The present invention relates to wall protecting assemblies in general and in particular to wall protecting assemblies having a semi-resilient cover member positioned in spaced relation relative to associated wall surfaces.

Outwardly protruding corners of building walls such as in hospitals and other public buildings are exposed to damage thereto from impact resulting from forceful contact with various kinds of vehicles, for example, stretchers, wheelchairs, dining carts and the like. Attempts have been made to provide a corner guard that will protect both the wall surfaces adjacent the corner from damage resulting from the impact and damage to the vehicle colliding with the corner. Corner guards have been designed that incorporate a metallic base plate which overlies the intersecting wall surfaces and a resilient cover member which is positioned in spaced apart relation from the base plate. Upon impact the resilient member will deform absorbing the force although, if the impacting force is great enough, the resilient cover member comes in contact with the base plate. These types of assemblies generally provide protection for corners in that the force is transmitted over a greater area instead of just at the edge of the corner itself thereby lessening the extent of damage to the wall cover, corner and the object striking the corner. Drawbacks in these types of assemblies are generally twofold. The first drawback is that upon total deformation of the resilient covering member the total brunt of the remaining impact is borne by the rigid base member, thereby transmitting a corresponding jolt or impact to the wall surfaces. In addition the object impacting on the base member may be damaged by a strong impact. Also, because of the resilient nature of the covering member, prior assemblies have been complicated to manufacture in order to dissuade vandals from detaching the covering member from the base plate.

OBJECTS OF THE INVENTION

Therefore, the objects of the present invention are: to provide a wall protecting assembly which is adapted to resiliently resist impacts administered thereto; to provide such an assembly that is designed to decrease the possibility of vandalism thereto yet is relatively simple to manufacture; to provide such an assembly which includes a substantially rigid base member which is attached to building wall surfaces adjacent an intersection thereof and which has extending outwardly from a vertex thereof, a cushioning member to resiliently cushion impacts received upon a covering member; to further provide such a base plate which has extending outwardly from webs thereof, stop means which substantially prevent inward deformation of side walls of such a covering member; to provide such a covering member which is semi-resilient in construction and which is capable of being snapped into place over an associated base plate; to provide such a base plate and covering member assembly which is capable of being mounted both exterior of wall surfaces adjacent an intersection thereof and flush with such wall surfaces; to further provide such a base member which is relatively easy to fabricate; and to provide such a wall protection assembly which is economical to manufacture, durable in use, attractive in appearance, and which is particularly well adapted for the intended purpose thereof.

Other objects and advantages of this invention will become apparent from the following description taken in connection with the accompanying drawings wherein are set forth by way of illustration and example certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
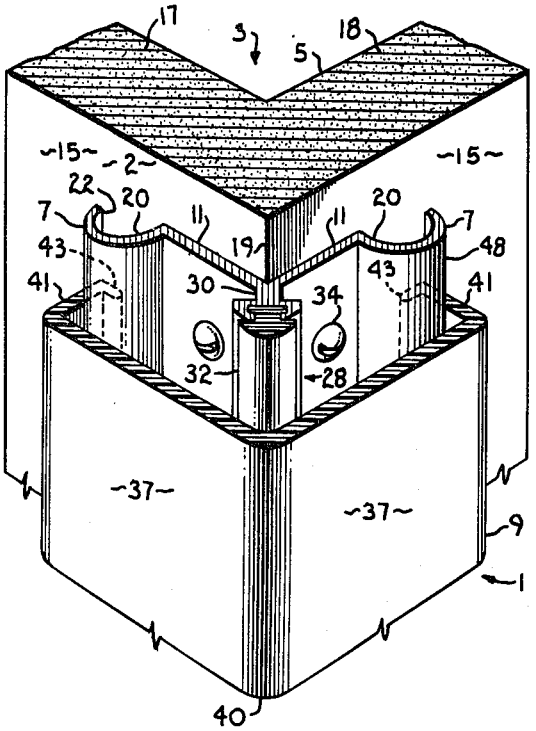
FIG. 1 is a fragmentary perspective view of a wall protection assembly embodying the present invention shown mounted on a corner associated with intersecting walls of a building.
Figure 2:
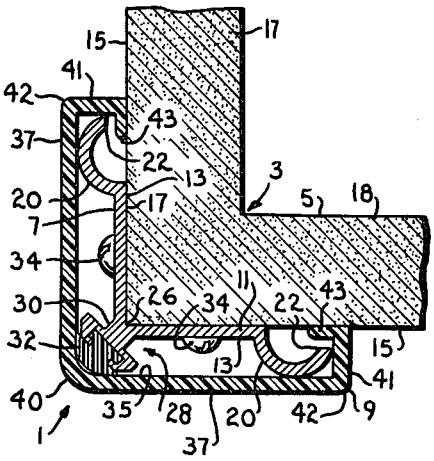
FIG. 2 is a fragmentary horizontal cross-sectional view of the wall protection assembly and the walls.

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting but merely as a basis for the claims and as representative basis for teaching one skilled in the art to variously employ the present invention in virtually any appropriately detailed structure.

Referring more in detail to the drawings, the reference numberal 1 in FIGS. 1 through 5 generally refers to a wall protection assembly embodying the present invention. The wall protection assembly 1 shown mounted on an outer side or corner area 2 of a wall intersection 3 of an associated adjoining building structure 5 so as to extend outwardly from and protect same. The wall protection assembly 1 comprises generally a base plate 7 which overlies the corner area 2 and a semi-resilient cover member 9 which is retained in spaced apart relation relative to base plate 7. The base plate 7 comprises two planar web members 11 shown as being angularly oriented toward each other such as to fully engage the corner area 2 which comprises portions of outwardly exposed wall surfaces 15 of two intersecting planar wall members 17 and 18 respectively near the intersection or corner edge 19 thereof. As shown in FIGS. 1 through 5, the angle formed at the intersection of webs 11 is approximately a 90 degree angle but it is understood that the webs can be fabricated to intersect at any included angle so as to fully engage wall surfaces 17 and 18 which do not intersect perpendicularly. It is also understood that the invention could be utilized on a rounded corner area wherein a curved surface would define the corner rather than a single edge.

The base plate 7 further comprises two flanges 20 which curve so as to extend outwardly relative to the building structure 5 from laterally spaced ends or edges 13 of the webs 11 so as to define between a free end 22 of each of the flanges 20 and an associated wall surface 15 a recess 24. As shown the flanges 20 are substantially arcuate in shape such that flanges 20 curve inwardly toward the wall surfaces 15, the function of which will be discussed later.

Extending outwardly from a vertex 26 of the base plate 7 and retainingly positioned between the base plate 7 and cover member 9 is an elongate cushion member 28. The cushion member 28 is positioned such as to bisect the angle formed by the webs 11 and also the angle formed by the intersection of the wall surface 15. The cushion member 28 comprises a substantially rigid finger 30 which is secured at one end to the base plate 7 and which has attached at the other end thereof a substantially resilient pad 32. The pad 32 is slidably received in a channel 33 of the finger 30 which is spaced slightly from the cover member 9. The base plate 7 is attached to the associated building structure 5 by fasteners such as screws 34 or the like.

The cover member 9 comprises two angled and, as illustrated, generally planar members or walls 37 having an apex 40 therebetween, the included angle (angle A in FIG. 1) of which is generally commensurate with that of webs 11 such that the cover member walls 37 are generally parallel to the webs 11.

Side members 41 project inwardly relative to the building structure 5 from the cover member walls 37 at edges 42 thereof horizontally spaced so as to be generally parallel to the apex 40. Tabs 43 are positioned at free ends of each of the side members 41 and project generally inwardly from side members 41 toward the apex 26 such that tabs 43 are substantially parallel to the cover member walls 37, which tabs 43 are each operably received in an associated recess 24. When the cover member 9 is positioned in covering relation with the base plate 7, the cushion member pad 32 engages an inner surface 35 of cover member 9 at a location adjacent the cover member apex 40. Also, the cover member 9 removably engages the flanges 20, however, the cover member 9 is sufficiently resilient yet stiff to resist removal of the cover member 9 from the base plate 7 and thereby dissuade vandalism. Yet one versed in the design of the assembly 1 can remove the cover member 9 from the base plate 7 to make repairs thereto.

Figure 3:
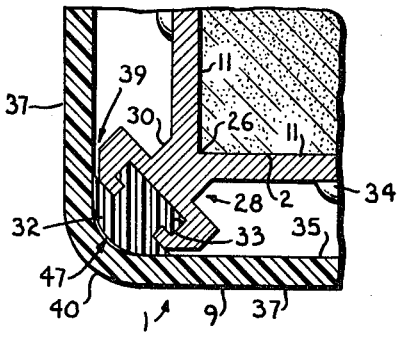
FIG. 3 is a fragmentary and enlarged cross-sectional view of the wall protection assembly and the walls taken along line 3—3 of FIG. 1.
Figure 4:
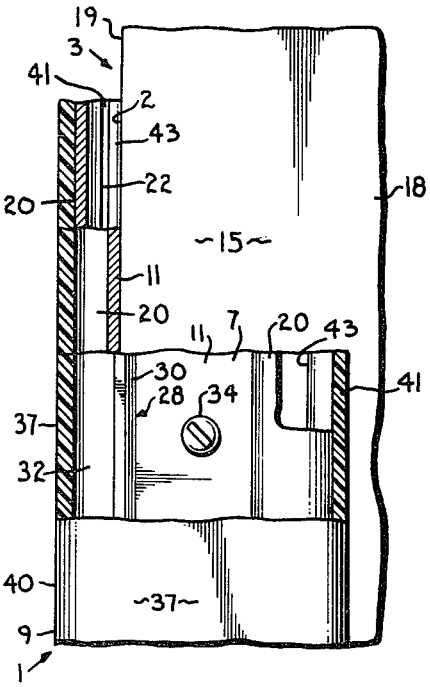
FIG. 4 is a fragmentary side elevational view of the wall protection assembly and the walls shown in FIG. 1 with portions broken away to show details thereof.
Figure 5:
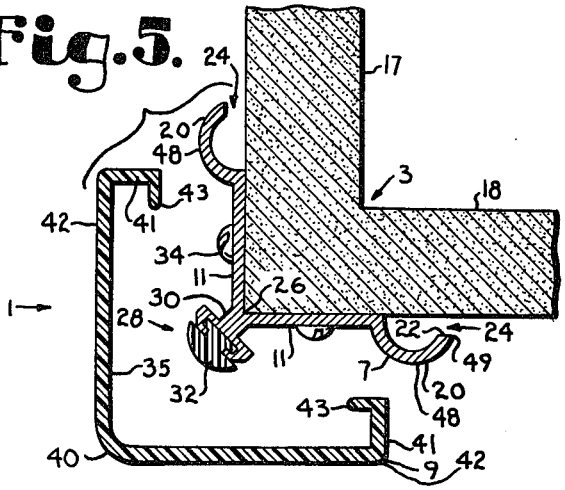
FIG. 5 is a horizontal cross-sectional and partly exploded view of the wall protection assembly and the walls with a cover member shown in spaced relationship to a base plate of the assembly.

It is noted that at the apex 40, as seen in FIG. 3, there is a slight gap 47 between the cover member 9 and the cushion member pad 32 which gap 47 extends outwardly along a portion of the engagement of the pad 32 and cover member 9.

It is also noted that there is a gap 39 between a most outward surface of the cushion member finger 30 and the cover member walls 37. This is so that upon inward deformation of the walls 37 during impact, the wall inner surface 35 will preferably not contact the cushion member finger 28.

The base plate 7, except for the cushion member pad 32, is substantially rigid and is preferably of unitary construction such as by being formed of an extruded metal, for example, aluminum or the like. The cushion member pad 32 is preferably made of resilient material so as to enable the pad 32 to resiliently resist deformation inwardly.

It is desirable for the cover member 9 to be resilient and at the same time resistant to damage by impacts and abrasions. Therefore, the cover member 9 is preferably made of a tough high impact plastic having limited resilience in the dimensions employed such as a polycarbonate, a suitable polycarbonate being sold commercially under the trademark "Lexan". It is also desirable for the material to be generally self extinguishing in the event of fire. Also, in hospital applications it is desirable for the material to be nonporous for resistance to bacterial growth thereon. The material mentioned generally fulfills these requirements.

In installation the base plate 7 is securely attached to the corner area 3 by fasteners 34. It is understood that the wall protection assembly 1 can extend vertically to any height desired by generally this height would be in the nature of three to four feet from the floor. It is noted the assembly 1 could also be used in conjunction with a horizontal corner. Once the base plate 7 is installed, the resilient cover member 9 is placed in covering position. One method of doing so is to slip a section of cover member 9 down onto the installed base plate 7 by positioning tabs 43 in recesses 24 and sliding the cover member 9 downwardly. Another method would be to slightly deform one wall of the cover member 9 thereby allowing one of the tabs 43 to be placed within an associated recess 24 and then urging the other tab 43 into the other associated recess 24 by simply exerting force on the cover member 9 which, because of its resilient nature will allow for the required deformation. In particular, the free tab 43 will engage an exterior surface 48 of an associated flange 20 and, since the flanges 20 are arcuate, the tab 43 will be forced outwardly by the applied force and, because of the resiliency of the cover member 9, once the tab 43 has been urged past an edge 49 of flange 20, the tab 43 will spring back inwardly and be received in recess 24 thereby interengaging the cover member 9 with the base plate 7 in a locking relation.

Upon installation, impacts to the cover member 9 are transmitted through the cover member 9 to the base plate flanges 20 and the cushion member 28. The cushion member pad 32 functions to resiliently resist inward deformation of the cover member 9. By resiliently resisting the inward deformation, the cushion member pad 32 acts to absorb the impact administered to the cover member 9. Further, the cushion member pad 32 along with flanges 20 urge the cover member 9 to remain in a spaced apart relation relative to the base plate 7.

It is noted that it is important that the fit of the cover member 9 on the base plate 7 be relatively tight thereby lessening exposure of the wall protection assembly 1 to unwanted disassembly such as by vandals. It is further noted that if the wall protection assembly 1 does not extend from the floor to the ceiling that an end cap (not shown) can be fitted thereover to prevent tampering therewith.

Figure 6:
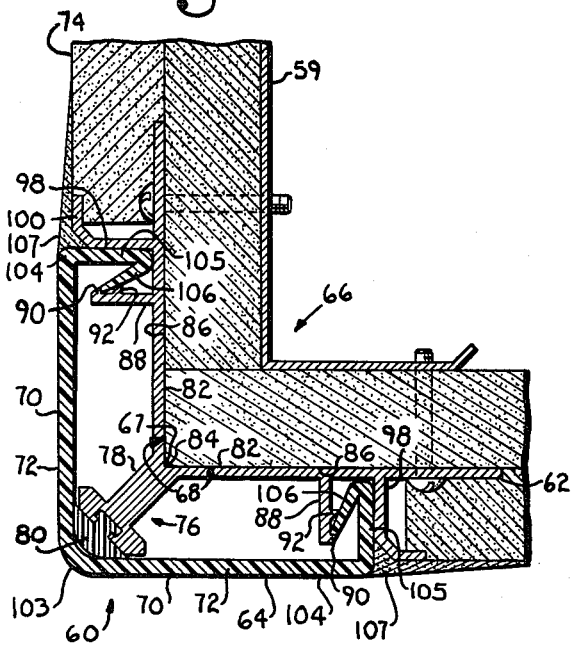
FIG. 6 is a fragmentary horizontal cross-sectional view of a first modified wall protection assembly according to the present invention flush mounted with respect to adjacent wall surfaces.
Figure 7:
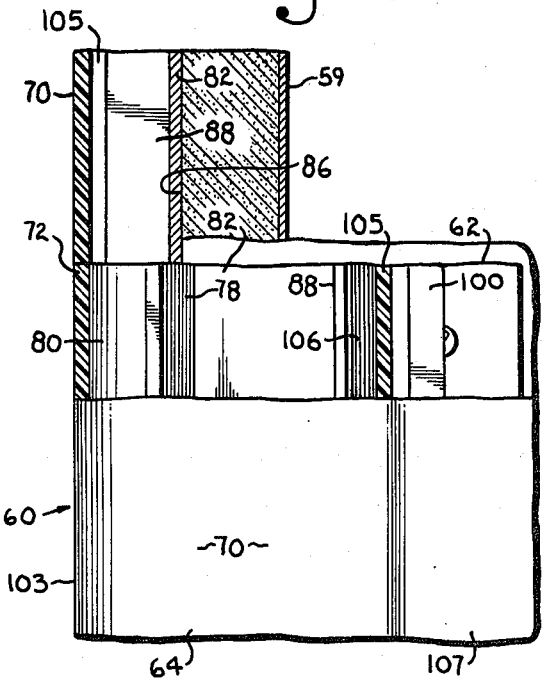
FIG. 7 is a fragmentary side elevational view of the first modified wall protection assembly and the walls as shown in FIG. 6 with portions broken away to show details thereof.

A protected wall assembly which is a first modified embodiment of the present invention and which is designed to be mounted flush with an associated building wall structure 59 is shown in FIGS. 6 and 7 and is generally designated by the reference numeral 60. The wall protector assembly 60 comprises a base plate 62 and a cover member 64. The base plate 62 is shown positioned on an outer or projecting side of an intersection 66 of portions of a building wall structure 59 such that exterior surfaces 70 of cover member walls 72 are generally flush with adjacent exterior surfaces 74 of the building wall structure 59 and protect a corner 67 and an associated adjacent corner area 68 on either side of the corner 67.

The base plate 62 includes two webs 82 which intersect at a vertex 84 such that when the assembly 60 is mounted on a structure 59 the webs 82 engage a surface 86 of the structure 59. Extending outwardly from the base plate vertex 84 such as to substantially bisect the angle defined by the intersection of the webs 82 is a cushion member 76 which comprises a finger 78 and a resilient pad 80. The cushion member 76 functions similarly to cushion member 28 as shown in FIGS. 1 through 5.

Flanges 88 extend outwardly from web 82 laterally from the cushion member 76. The flanges 88 include at a free end thereof a shoulder portion 90 which extends substantially parallel to the wall surface 74 and away from the base plate vertex 84 and terminates at an end 96. A rib 92 extends outwardly from a middle portion of the flanges 88.

Fingers 98 extend outwardly from base plate webs 82 at a position laterally spaced from flanges 88 and include an end 100 thereof which is positioned substantially flush with the wall exterior surface 74.

The cover member walls 72 intersect at an apex 103, the included angle of which is such that walls 72 are substantially parallel with webs 82 and the exterior surfaces 70 thereof are generally flush with the associated building wall structure outer surface 74. At lateral ends 104 of cover member walls 72, side members 105 are attached which extend inwardly toward the base plate webs 82. The side members 105 have connected thereto a spring latch 106 extending laterally inwardly and toward the cover member walls 72.

The cover member 64 is fastened to or installed on the base plate 62 in a substantially similar way as cover member 9 is positioned on base plate 7 of the embodiment shown in FIGS. 1 through 5. The spring latches 106 operably engage respective shoulder portions 90 to retain the cover member 64 on the base plate 62 and are held thereagainst by ribs 92 which abut against the spring latches 106.

It is noted that the building wall 59 is fabricated such that there is a recess 110 in which to mount the wall protector assembly base plate 62. This allows for the cover member wall exterior surfaces 70 to be substantially flush with the building wall structure outer surface 74. Feathering such as by joint cement, tape or the like as at 107 could be applied to assure that the transition between the building wall surfaces 74 and the cover member outer wall surfaces 70 is smooth and that any spacing that might exist between the corner guard wall side members 105 and the base plate fingers 98 is sealed preventing the infusion therein of bacteria or the like. Further, such a seal would also impede unwanted disassembly of the wall protection assembly 60 by vandals or the like.

Figure 8:
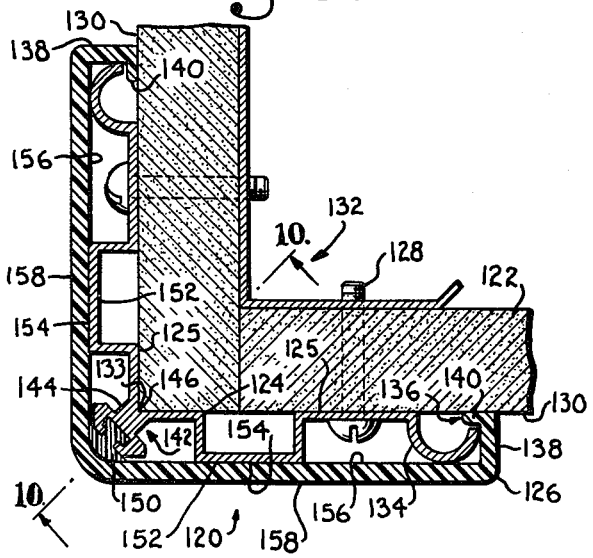
FIG. 8 is a fragmentary horizontal cross-sectional view of a second modified wall protection assembly according to the present invention shown mounted on a corner area of associated walls.
Figure 9:
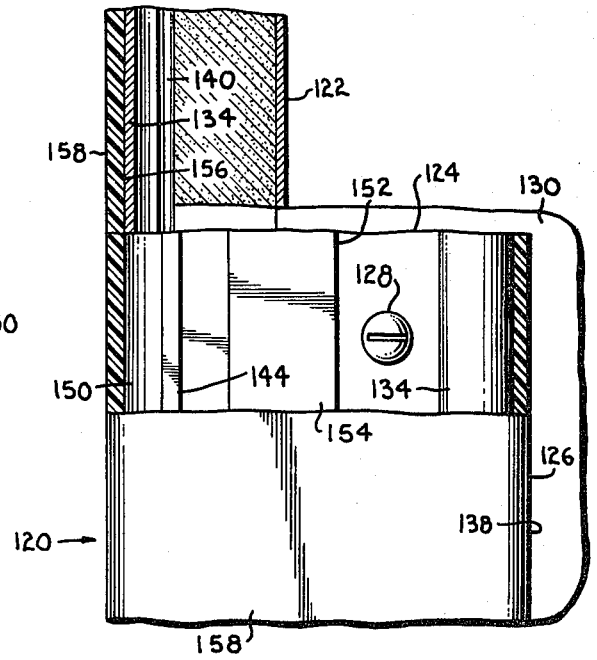
FIG. 9 is a fragmentary side elevational view of the second modified wall protection assembly and the walls as shown in FIG. 8 with portions broken away to show details thereof.
Figure 10:
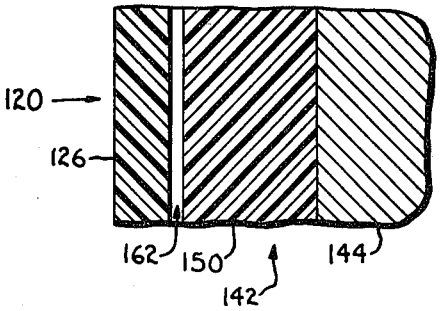
FIG. 10 is a fragmentary and enlarged cross-sectional view of the wall protection assembly and the walls taken along line 10—10 of FIG. 8.

A wall protection assembly comprising a second modified embodiment of the present invention is shown in FIGS. 8, 9 and 10 and is generally designated by the reference numeral 120. The wall protection assembly 120 is structurally similar to the wall protection assembly 1 as shown in FIGS. 1 through 5, and is similarly attached to an associated section of a wall structure 122.

The wall protector assembly 120 comprises a base plate 124 having webs 125 and a cover member 126. The base plate is secured by fasteners such as screws 128 or the like to an exterior surface 130 of the wall structure 122. As shown, the wall structure 122 further comprises an intersection 132 of portions of the wall structure 122 and an externally projecting corner 133 about which the assembly 120 is located.

The means by which the cover member 126 is secured to the base plate 124 is similar to that used before. At lateral extremities of the base plate webs 125 are curved flanges 134 which extend outwardly from respective wall structure surfaces 130 to define therebetween a recess 136. Depending toward the corner 133 from associated cover member side members 138, similar to the previous embodiment, are tabs 140 which are operably received within respective recess 136. A cushion member 142 comprises a finger 144, which extends outwardly from a vertex 146 formed at the intersection of webs 125, and a cushion member pad 150. The cushion member 142 functions to position the cover member 126 in spaced relation with respect to the base plate 124. The webs 125 at locations intermediate the cushion member finger 142 and flanges 134, each include protruding outwardly therefrom a generally nonflexible spacer means such as the illustrated stop member 152 extends outwardly in a generally non-flexible manner to an extent such that an outer surface 154 thereof engages an inner surface 156 of wall members 158 of cover member 126 when the cover member 126 is in covering relation relative to the base plate 124, that is in protecting relation to the corner 133. As seen in FIG. 10 the cushion pad 150 is preferably spaced slightly from the cover member 126 at least in part thereby producing a gap 162.

Figure 11:
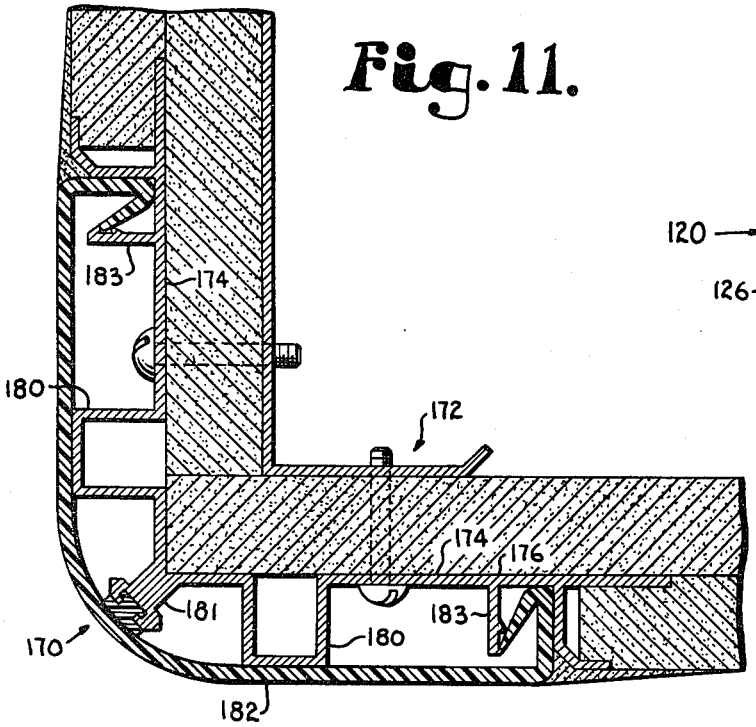
FIG. 11 is a fragmentary horizontal cross-sectional view of a third modified wall protection assembly according to the present invention mounted on a corner area of associated walls.

It is seen that comparing the cover member 9 of the embodiments shown in FIGS. 1 through 5 and cover member 126 of the embodiment shown in FIGS. 9, 10 and 11 that the wall members 158 of cover member 126 are longer than walls 37 of cover member 9. Since the cover member 126 is made of a semi-resilient material similar to cover member 9, it is possible that the cover member wall 158 could be deformed by pressure exerted intermediate the corner 133 and one of the flanges 134 such that the wall protection assembly 120 could be inadvertently disassembled. Because of this, the stop members 152 are formed to engage the cover member wall 158 and function to prevent or discourage any inadvertent or unplanned disassembly of the wall protector assembly 120. Since the stop members 152 are spaced from cushion member 142, any blows received at the cushion member 142 will still be resiliently resisted by pad 150 such as before.

A third modified embodiment of a wall protection assembly in shown in FIG. 11 and is generally referred to by the reference numeral 170. The wall protector assembly 170 is flushly mounted with an associated wall structure 172 and is very similar in design and operation to the wall protection assembly 60, shown in FIGS. 6 and 7. It is noted that webs 174 of a base plate 176 of the wall protector assembly 170 are longer than webs 82 of wall protector assembly 60 and therefore stop members 180 are formed in web 174 such as in the embodiment of the assembly 120, as is shown in FIGS. 8 and 9. The assembly 170 includes a cushion member 181, cover member 182 and cover member holding flanges 183 associated with the base plate 176 similar in construction to the previous embodiment.

Figure 12:
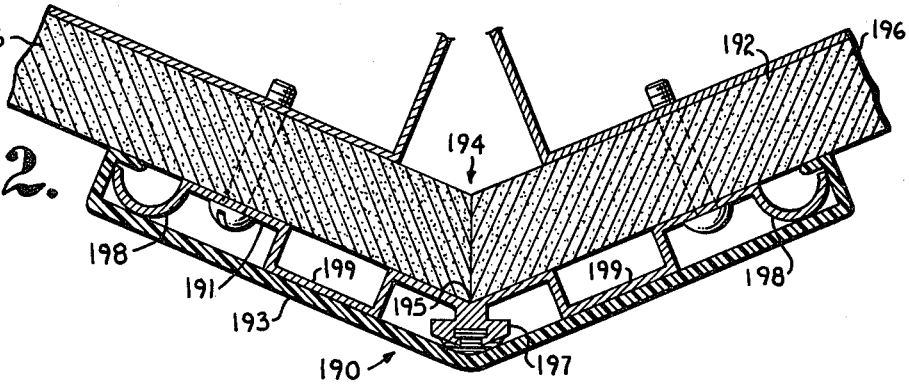
FIG. 12 is a fragmentary top cross-sectional view of a fourth wall protection assembly according to the present invention mounted on a corner area of associated walls.

In FIG. 12 a fourth modified embodiment of a wall protector assembly is shown and is generally designated by the reference numeral 190. The assembly 1 comprises a base plate 191 and a cover member 193. The wall protector assembly 190 is similar in design and function to the assembly 120 which is shown in FIGS. 8 and 9 but, as shown in FIG. 12, the base plate 191 of the wall protector assembly 190 is adapted to be positioned on an associated wall structure 192 which wall structure has an intersection 194 at a corner 195 formed by the joining of wall members 196 which wall members 196 do not intersect at right angles. The base plate 191 includes a cushion member 197 extending outwardly from the bisection of the angle formed by the intersection of the wall members 196 and flange members 198 spaced from the cushion member 197 for retaining the cover member 193 on and in spaced relation to the base plate 191. The base plate 191 also includes a stop member 199 on either side of the cushion member 197 intermediate the cushion member 197 and a respective flange 198. The stop members 199 generally help to maintain the spacing between the cover member 193 and the base plate 191 in cooperation with the cushion member 197.

Figure 13:
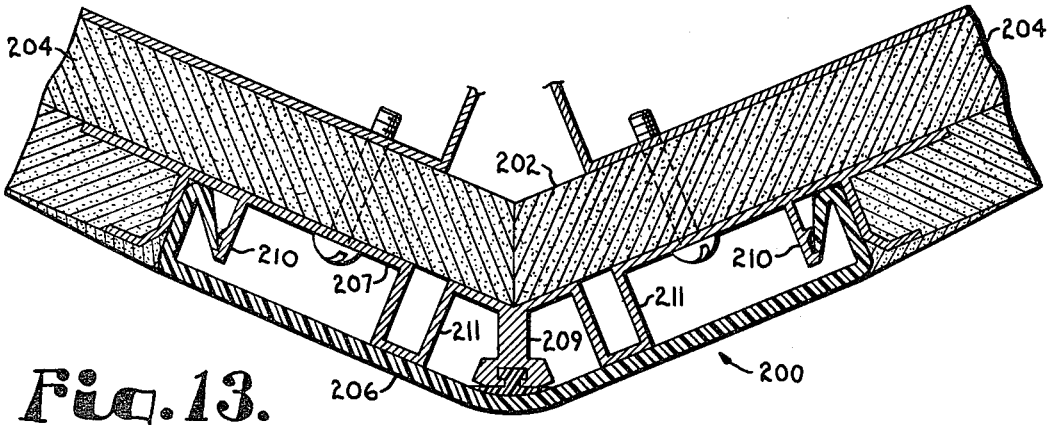
FIG. 13 is a fragmentary horizontal cross-sectional view of a fifth modified wall protection assembly according to the present invention mounted on associated walls.

A fifth modified embodiment of a wall protector assembly is shown in FIG. 13 and is generally designated by the reference numeral 200. The wall protector assembly 200 is shown as being flushly mounted in an associated wall structure 202 in a similar way as wall protector 170 is mounted in associated wall 172, as in the fourth modified embodiment shown in FIG. 11. The wall protector assembly 200 is shown installed on a wall structure 202 wherein associated wall members 204 intersect at angles substantially different from a right angle. The assembly 200 comprises a cover member 206 and a base plate 207. The base plate 207 includes a cushion member 209, cover member retaining flanges 210 and stop members 211 each of which is similar in design and function to similarly named parts of the previous embodiment.

It is to be understood that while certain forms of the present invention have been described and illustrated, it is not to be limited thereto except insofar as such limitations are included in the following claims.

What is claimed and desired to secure by Letters Patent is:

1. A corner protection assembly secured to a corner area of a wall structure comprising surfaces of two non-planar wall members intersecting at an angle for protecting the corner from damage resulting from impacts thereto when said assembly is operationally positioned over said corner; said assembly comprising:

(a) a semi-resilient cover member having opposite ends and an apex spaced from and between said cover member ends; said cover member apex being positioned so as to align with the corner when the assembly is operationally positioned so as to be secured to the corner area of the wall structure and such that said apex is generally aligned with a plane bisecting the angle of the intersecting walls when the assembly is operationally positioned; each of said ends being adapted to be connected to one of said wall members at a location spaced from the corner; said cover member overlying the corner area when operationally positioned;

(b) spacing means generally extending between said corner and said cover member in the region of said cover member apex so as to retain said cover member in spaced apart relation with respect to the corner when said cover member is operationally positioned; and (c) resilient stop means retainingly positioned between said cover member and the corner area allowing partial deformation of said cover member inwardly to cushion impacts thereto and cooperating with said spacing means to urge said cover member in spaced apart relation with respect to said corner.

2. An assembly according to claim 1 including:

(a) a rigid base plate spaced between said cover member and said wall members when said assembly is operationally positioned; said resilient means comprising a cushion positioned between said base plate and said cover member so as to be connected to said base plate and be near said cover member when the latter is not deformed and further being generally positioned so as to be in a plane bisecting the angle formed by the intersecting wall members when said cover member is operationally positioned over the corner; said spacing means comprises stops positioned on either side of said cushion intermediate said cushion and said cover member ends; and said cover member ends being removably connected to said base plate.

3. A corner protection assembly being operationally positioned over a corner area of a building wall to protect the corner area from damage resulting from impacts thereto; said corner being defined by the intersection of a pair of building wall members intersecting at a non-planar angle; said assembly comprising:

(a) a semi-resilient cover having first and second wall members intersecting at an angle and opposite ends; each of said ends being connected to opposite sides of the corner area respectively when said assembly is operationally positioned;

(b) first and second stop members positioned intermediately along said first and second wall cover members respectively and biasing said cover from the corner area in spaced relation with respect to the corner area when said assembly is positioned thereover; said cover member ends being connected to respective stop members and each including structural means requiring said ends to be biased away from said corner along said building wall members before said ends may be moved outward from said building wall members; and (c) a support member extending generally between said corner and the said cover in the region where said cover walls intersect and cooperating with said stop members to allow minor deflection of said cover member when inparted thereon but to prevent substantial deflection of said cover toward said building wall members so as to limit accidental and unauthorized removal of said cover from said corner area when said assembly is operationally positioned.

4. A corner protection assembly operably positioned over a corner defined by the intersection of two wall members intersecting at an angle; said assembly having an apex generally in a plane bisecting the angle of intersection of the walls defining the corner and overlying said corner when in the operable position thereof; said assembly comprising:

(a) a substantially rigid base plate attached to said wall members when said assembly is in the operable position thereof; said base plate overlying said corner apex and extending substantially outward from said corner apex along said wall members when said wall base plate is mounted on said wall members; said base plate including:

(1) first and second members joined at the corner apex and extending outward from said corner apex along and conforming with associated wall members when said base plate is mounted on said wall members in the operational position of said assembly;

(2) a substantially rigid finger having an outer end; said finger positioned to generally be in a plane bisecting the angle of intersection of the walls and extending outwardly from said corner apex when said base plate is mounted on said wall members; and (3) first and second stop members extending outwardly from respective base plate members and substantially laterally spaced from said corner apex along respective wall members when said base plate is mounted thereon;

(b) a semi-resilient cover member having first and second walls and opposite ends and having an inner surface; each said cover member end being removably connectible to said base plate such that said cover is positioned in overlying relation to said base plate and said corner when said base plate is mounted on said wall member;

(c) said first and second stop members being positioned intermediately between said apex and respective cover member ends and further positioned along said first and second cover walls respectively such that said cover is biased into spaced relation from said corner by said finger and said stop members;

(d) said finger operably engaging said cover member inner surface upon inward deformation of said cover member and operably cooperating with said stop members to disuade removal of said cover member from said base plate.

5. The assembly according to claim 4 wherein:

(a) said finger includes a resilient pad mounted on said outer end and operably engaging said cover inner surface to prevent inward deformation of said cover at said apex.

6. The assembly according to claim 4 wherein:

(a) said cover member ends each include flanges which fit over and mate with said stop members such that said cover member ends must be biased along said wall members away from said apex to allow removal of said cover member from said base plate; and (b) said finger and said stop members cooperate to prevent extensive deformation of said cover member toward said corner member so as to reduce the ease of biasing the cover member ends outward from the apex thereby discouraging inadvertent or deliberate disassembly of said assembly.

7. The assembly according to claim 6 including:

(a) said wall members joining at an angle of approximately 90 degrees at said corner.

* * * * *